US005090675A

United States Patent [19]

Nagai et al.

[11] Patent Number: 5,090,675

[45] Date of Patent: Feb. 25, 1992

[54] APPARATUS FOR AUTOMATICALLY TRANSPORTING SHEETS OF ORGINAL

[75] Inventors: Hiroyuki Nagai, Toyonaka; Jun Miyoshi, Higashiosaka, both of Japan

[73] Assignee: Mita Industrial Co., Ltd., Osaka, Japan

[21] Appl. No.: 559,355

[22] Filed: Jul. 30, 1990

[30] Foreign Application Priority Data

Aug. 16, 1989 [JP] Japan ..... 1-211024

[51] Int. Cl.[5] ..... B65H 3/06

[52] U.S. Cl. ..... 271/10; 271/110; 271/118; 271/122; 271/902

[58] Field of Search ..... 271/186, 291, 301, 902, 271/110, 111, 118, 122, 242, 10

[56] References Cited

U.S. PATENT DOCUMENTS 4,223,886 9/1980 Vogt ..... 271/902 X
4,411,517 10/1983 Gerken ..... 271/902 X
4,632,376 12/1986 DuBois .
4,975,749 12/1990 Tsunoda ..... 271/902

FOREIGN PATENT DOCUMENTS 60-93049 5/1985 Japan .
63-201644 8/1988 Japan .

*Primary Examiner*—Richard A. Schacher
*Attorney, Agent, or Firm*—Beveridge, DeGrandi & Weilacher

[57] ABSTRACT

The apparatus is for automatically transporting sheets of original to a reading position on a plane member of an image forming apparatus. The apparatus includes an assembly for setting in position or accommodating sheets of original, an assembly for feeding the sheets, a transporting rolling device and a guiding device. The sheet setting assembly is located beside the plane member. The sheet feeding assembly is for feeding a sheet from the sheet setting assembly. The transporting rolling device presses on the plane member of the image forming apparatus to transport a sheet from the sheet feeding assembly by means of nipping the sheet against the plane member. The guiding device is located at a place adjacent to the transporting rolling device and ahead or upstream of it, with respect to the sheet transporting stream, for guiding the leading edge of the sheet to the nipping position between the transporting rolling device and the plane member. A second guiding device, a discharge guiding device, is positioned upstream of the first guiding device and allows the sheet to pass by it in the feeding direction and acts to guide the sheet when being discharged. The apparatus may be applied to copying machines.

27 Claims, 8 Drawing Sheets

PRIOR ART

APPARATUS FOR AUTOMATICALLY TRANSPORTING SHEETS OF ORGINAL

BACKGROUND OF THE INVENTION

The present invention relates to an apparatus for automatically transporting sheets of original. More specifically, the invention relates to an apparatus for automatically transporting sheets of original from an original stacking part, in which the sheets of original are stacked, to a position in an image forming apparatus for reading information from the original.

A copying machine, for example, may have an automatic document feeder (referred to as ADF below) on its upper surface. The ADF has a tray for original in which sheets of original are stacked, an original transporting system, and an original discharging part. In the ADF, the sheets of original in the original tray are transported one by one by the original transporting system to a contact glass in the copying machine. Then, the image information from the original is read by a reading system in the copying machine. After the image information is read, the sheet is discharged to the original discharging part by the original transporting system.

Original transporting systems of ADFs such as the above ADF usually consist of a belt mechanism, and a roller mechanism to drive the belt, as disclosed in U.S. Pat. No. 4,589,650 and Japanese Patent Laying-Open No. 201644/1988. An apparatus according to the disclosure in the above documents must be large and have complex structure. Consequently, not only automatically feeding sheets of original, but also, manually setting a stack of original, such as a book, are difficult for an operator using the conventional ADF of a small or a mid-size type of machine.

U.S. Pat. No. 4,632,376 discloses an apparatus which comprises an original transporting system and which includes a simple structure comprised of a plurality of rollers, instead of a belt mechanism. However, the apparatus is unwieldy, since the original stacking part and the original discharging part are disposed above the contact glass. Therefore, it is difficult for an operator to open or close the apparatus manually. Furthermore, the apparatus has a U-shaped path for feeding sheets of original, whereby the sheets occasionally are not set in the proper position on the contact glass, but out of the proper position.

To solve the above problems, the commonly assigned, copending U.S. patent application Ser. No. 07/322,914, discloses an ADF comprising an original transporting system of simple mechanism, suitable for small-size and mid-size copying machines. This ADF can be opened and closed easily, and seldom causes improper positioning of original sheets (the Japanese counterpart application was published as Japanese Patent Laying-Open No. 236126/1989 on Sept. 21, 1989, later than the priority date of this application).

FIG. 1 shows a part of the original transporting system of the above application. The original transporting system includes a transporting roller 2 which presses against a contact glass 1. Sheets of original are transported from an original stacking part 3 located beside the contact glass 1 through a discharge guide 4 to the nipping position between the contact glass 1 and the transporting roller 2. Then, the sheet of original is nipped between the transporting roller 2 and the contact glass 1 in order to correct its position in the transportation, and it is transported by the transporting roller 2 to the right in FIG. 1, until the sheet is located in a predetermined position on the contact glass 1. Thus, the transporting roller 2 functions herein not only for transporting the sheet, but also for resisting the sheet, in order to correct the sheet position. After the information from the sheet of the original is read by the original reading apparatus of the copying machine, the transporting roller 2 starts rotating in the opposite direction, shown by the dotted arrow in FIG. 1, so that the sheet of original is scooped by the discharging guide 4 and then discharged to the original discharging part located above the contact glass 1.

However, guiding an edge of an original sheet to the nipping position is sometimes difficult in a transportation system comprising the contact glass 1 and the transporting roller 2 which presses thereon, by comparison to a transportation system comprising a pair of rollers which press on each other, or a transportation system including a belt. Particularly, in the transportation system shown in FIG. 1, the outer surface of transporting roller 2 must be made of a friction material, such as resin, due to the fact that it must perform a plurality of functions—as a resist roller, a supplying roller, and a discharging roller—on the contact glass. Accordingly, it is sometimes difficult to guide the leading edge of a sheet of original into the nipping position, after the edge of the sheet has moved onto the surface of the transporting roller 2. It can easily happen that the edge of a thin sheet of original becomes curled, causing defective transportation.

SUMMARY OF THE INVENTION

It is an object of the present invention to provide an apparatus for automatically transporting sheets of original which properly transports the sheets of original by means of transporting rolling device which presses against a plane member.

It is another object of the present invention to provide an apparatus for automatically transporting sheets of original whereof the height is reduced and the structure is simplified.

It is a further object of the present invention to provide an apparatus for automatically transporting sheets of original wherein improper setting of original is decreased.

An apparatus for automatically transporting sheets of original according to the present invention comprises an apparatus for supplying sheets of original to the original-reading position on a plane member of an image forming apparatus. It comprises a means for setting the sheets, a means for feeding the sheets, a transporting rolling device and a guiding means. The sheet setting means is located beside the plane member. The sheet feeding means is for feeding a sheet from the sheet setting means. The transporting rolling device presses against the plane member of the image forming apparatus in order to transport a sheet from the sheet feeding means by nipping the sheet against the plane member. The guiding means is disposed in a position lateral to the transporting rolling device and ahead of it, with respect to the sheet transporting stream, for guiding the leading edge of a sheet to the nipping position between the transporting rolling device and the plane member.

According to the present invention, a sheet of original transported from the sheet setting means by the sheet feeding means is nipped by the transporting rolling device against the plane member, and then it is transported by the rotation of the transporting rolling device to a predetermined position on the plane member.

When a sheet of original is transported to the transporting rolling device, the leading edge of the sheet reaches the guiding means first, which is located, with respect to the paper stream, ahead of the transporting rolling device, and then moves along the guiding means to the nipping position between the transporting rolling device and the plane member. Therefore, even if the edge of the sheet becomes curled, the curled part is reformed by the guiding means, whereupon the end of the sheet may be properly nipped by the transporting rolling device against the plane member.

These and other objects and advantages of the present invention will be more fully apparent from the following detailed description.

DESCRIPTION OF THE PREFERRED EMBODIMENT

Figure 1:
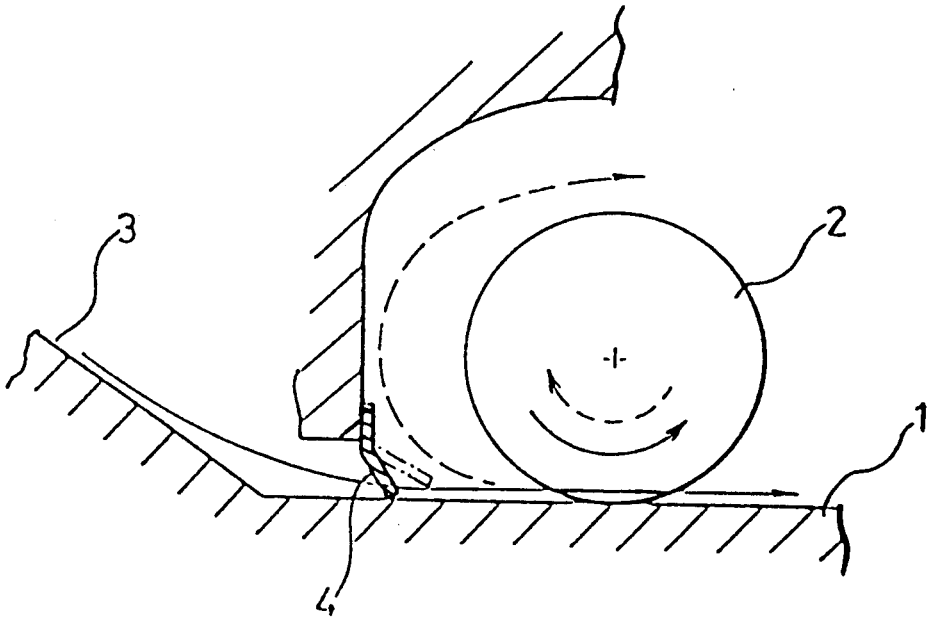
FIG. 1 is a sectional front view showing a part of an apparatus for automatically transporting sheets of original as disclosed in the specification of the aforementioned copending application.
Figure 2:
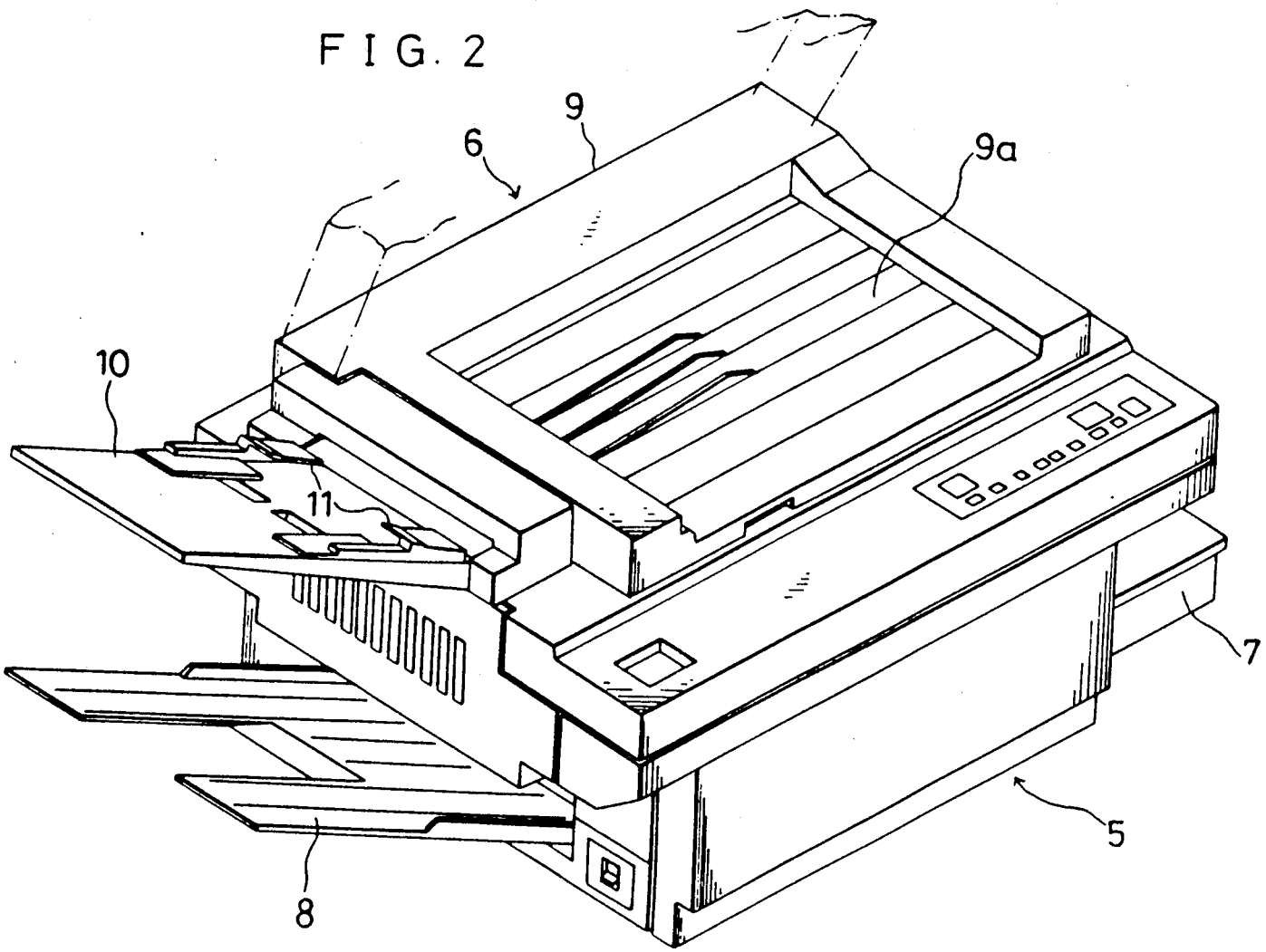
FIG. 2 is an isometric view of a copying machine to which an ADF according to the present invention is applied.

FIG. 2 shows an appearance of a copying machine to which an ADF according to the present invention is applied.

The ADF 6 of the present invention is located on the copying machine body 5. In the right-side portion of the copying machine body 5, a paper cassette case 7, which is detachable, is disposed. Disposed in the left side portion of the copying machine body 5 is a copy tray 8.

Figure 3:
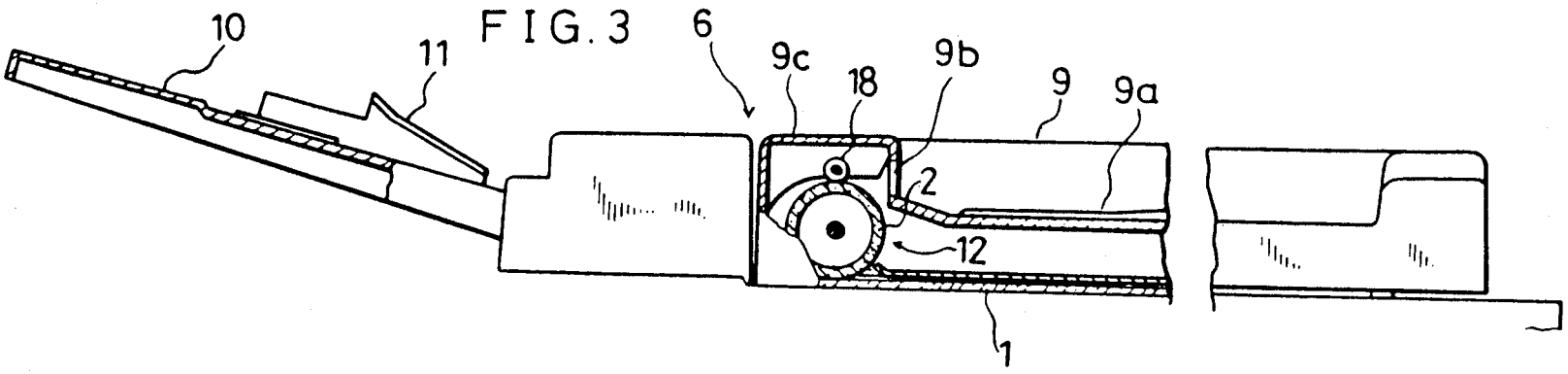
FIG. 3 is a partially sectional front view showing part of the ADF.

The ADF 6 comprises a main part 9 and a tray 10 for stacking sheets of original (referred to as an original tray below). The main part 9 is pivotable on its rear axis, located along the rear of the machine body, between the closed position shown with solid lines, and the opened position shown by partially-dotted lines in FIG. 2. The ADF 6 is set in the closed position when the sheets of original are transported automatically, whereas it is in the open position when the sheets of original are set manually. The ADF 6 has a depression 9*a*, in the upper portion of the main part 9, to receive sheets of discharged original. In the main part 9, as shown in FIG. 3, a sheet feeding mechanism 12 is provided in the left side portion, or the side for receiving sheets. Formed between the upper portion of the sheet feeding mechanism 12 and the depression 9*a* is an opening 9*b* in a housing 9*c* extending in the depth direction, or the direction perpendicular to the plane of FIG. 2, to allow sheets to be discharged therethrough.

As shown in FIG. 2, a pair of adjusters 11 are provided on the tray 10 to position the sheets of original in the center of the tray 10. The adjusters 11 may be moved both toward each other and in opposing directions.

Figure 4:
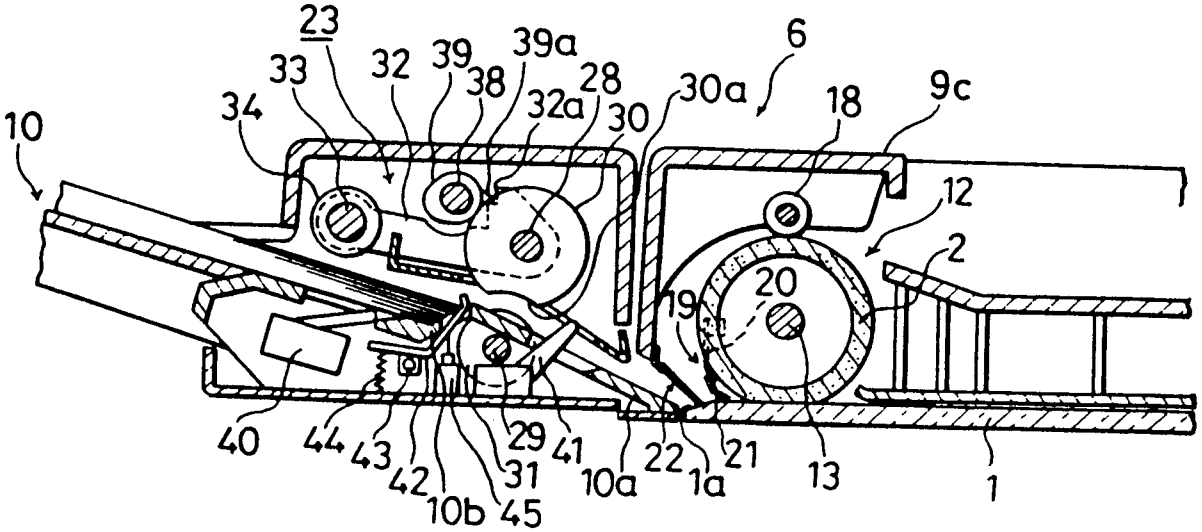
FIG. 4 is a sectional front view showing the sheet feeding mechanism and the transporting mechanism of the ADF.
Figure 5:
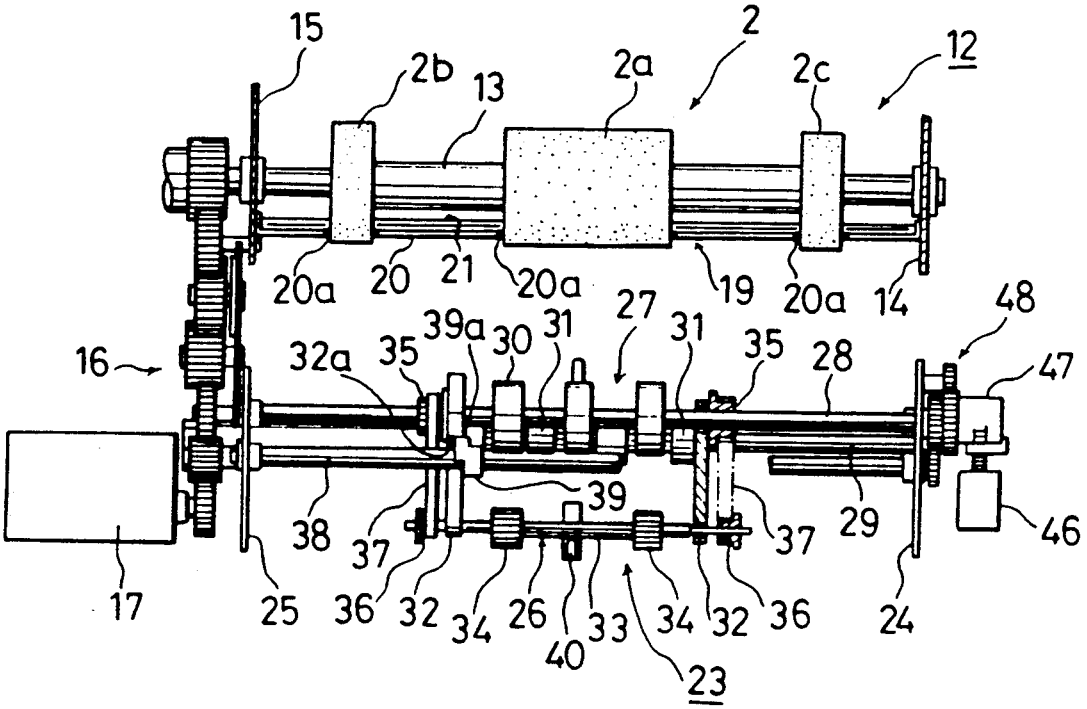
FIG. 5 is a plan view showing the sheet feeding mechanism and the transporting mechanism of the ADF.

As shown in FIGS. 3 and 4, the sheet feeding mechanism 12 in the main part 9 comprises a contact glass 1 as a plane member and a transporting roller 2 which presses against the contact glass 1. The contact glass 1 is disposed in the upper surface of the copying machine body 5, on which the sheets of original having bottom-surface images are located. The contact glass 1 has a slope 1*a* which descends toward the tray 10 along its edge adjacent to the tray 10. The transporting roller has a circumferential surface layer consisting of artifically composed resin. As shown in FIG. 5, the transporting roller 2 is divided into a central roller portion 2*a* which is relatively wide, and side roller portions 2*b* and 2*c* separate from the portion 2*a* by predetermined distances on either side of the portion 2*a*. The roller portions 2*a* to 2*c* are fitted on a rotating rod 13 which is rotatably supported by a pair of side plates 14 and 15 located toward the front and rear ends. An end of the rod 13 is connected to a motor 17 through a spring clutch mechanism and a solenoid (both not shown) and a gear train 16. As shown in FIGS. 3 and 4, a counter roller 18 for discharging sheets presses against the upper portion of the transporting roller 2.

Figure 6:
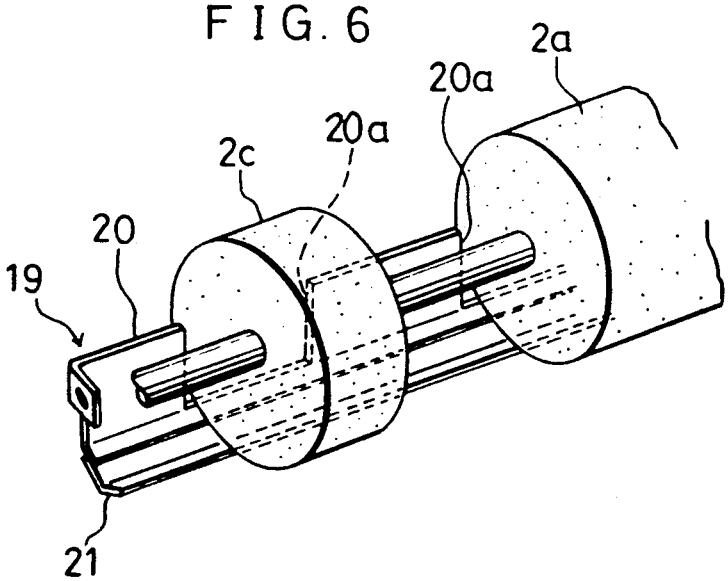
FIG. 6 is an isometric view showing a part of the ADF.

A guiding means 19 is provided, as shown in FIGS. 4 to 6, to guide a sheet between original from the tray 10 to the nipping position between the contact glass 1 and the transporting roller 2. The guiding means 19 is located adjacent to the transporting roller 2 and ahead of the nipping position with respect to the sheet transportation stream. The guiding means 19 comprises a support member 20 and a guide member 21. The support member 20, as shown in FIGS. 5 and 6, extends in the depth direction and is fixed to the side plates 14 and 15 at both its ends. The support member 20 has notches in portions which correspond to the roller portions 2*a* to 2*c*. The guide member 21 is a plate made of stainless steel and fixed to the bottom end of the support member 20. The guide member 21 is turned in a "L" shape and is separated from the contact glass 1 by a predetermined gap, whereby the edge of a sheet of original is guided into the nipping position. The guide member 21 extends uniformly along the support member 20 from the front end to the rear end.

A discharging guide 22 is provided between the tray 10 and the guiding means 19. The discharging guide 22 allows a sheet to progress from the tray 10 to the contact glass 1 by virtue of its flexibility whereas it prevents the sheet from regressing from the contact glass 1 to the tray 10, and thereby it scoops the sheet. The discharging guide 20, which is made of a resin film, such as polyester film, has its upper end adhered to the left side wall of the housing 9*c* of the main part 9 and its bottom end in flexible contact with the slope 1*a* of the contact glass 1. In its free condition, the discharging guide 22 would extend below the level of the slope 1*a* of the contact glass 1.

Now, referring to FIGS. 4 and 5, a sheet feeding mechanism 23 located in the base of the original tray 10 will be described. In the lower end of the tray 10, there are a slope 10*a* descending toward the contact glass 1, and a stopper 10*b*, descending from the top of the slope 10*a* in the opposite direction, for stopping a stack of original. On both sides of the bottom end of the original tray 10, standing plates 24 and 25 are provided.

Disposed between the front standing plate 24 and the rear standing plate 25 are a feeding roller mechanism 26 and a separating roller mechanism 27 which will be described in the following.

An upper rotation axis 28 and a lower rotation axis 29 separate from each other by a predetermined distance in the vertical direction are rotatably supported by the front and rear standing plates 24 and 25. The upper rotation axis 28 has three feeding rollers 30 fixed thereon which are separate from each other by a predetermined distance. As shown in FIG. 4, each of the outer circumferential surfaces of the feeding rollers 30 is not a perfect circle because each roller 30 has a notch 30*a*. The lower rotation axis 29 has four reverse rollers 31 fixed thereon which are separate from each other by a predetermined distance. The notch 30*a* has a curved surface corresponding to the circumferential surface of the reverse rollers 31. As shown in FIG. 5, the feeding rollers 30 and the reverse rollers 31 are disposed alternately with respect to the lateral direction of the figure.

A pair of supporting arms 32 are rotatably supported by the upper rotation axis 28 at their bases. The supporting arms 32 extend toward the upper portion of the original tray 10, and support a rotation axis 33 rotatably at their free ends. Between the supporting arms 32, the rotation axis 33 has a pair of feeding rollers 34 separate from each other by a predetermined distance and fixed thereto.

The upper rotation axis 28 has a pair of toothed pulleys 35 fitted thereon, adjacent to the bases of the pair of supporting arms 32. The rotation axis 33 also has a pair of toothed pulleys 36 fitted thereon which are contraposed to the toothed pulleys 35, and timing belts 37 are provided between each contraposed pair of the pulleys 35 and 36 in order to connect them.

Furthermore, a cam axis 38 is rotatably supported by the front standing plate 24 and the rear standing plate 25 therebetween. The cam axis 38 has a pair of cams 39 fitting thereon, adjacent to the supporting arms 32. Each cam 39 has a driving projection 39*a*. Meanwhile, each base portion of the supporting arms 32 has a plane mounting surface 32*a*. When the cams 39 are located in the held position as shown in FIGS. 4 and 5, the mounting surfaces 32*a* of the supporting arms 32 are against the driving projections 39*a* of the cams 39, whereby the supporting arms 32 are maintained in the upper position as shown in FIGS. 4 and 5.

Referring to FIG. 4, there are a set-sheet-detecting switch 40 and a fed-sheet-detecting switch 41 provided in the base part of the original tray 10. Located in the stopper 10*b* of the tray 10 is a hold-back member 42 which is rotatable on a pin 43 extending in the depth direction. Under the hold-back member 42, a tension spring 44 is provided for maintaining a counterclockwise torque on the hold-back member 42 in FIG. 4, and an electromagnetic solenoid 45 is provided for clockwise torque on the hold-back member 42.

Referring to FIG. 5, in the front of the upper rotation axis 28, or at the right side of the figure, a solenoid 46, a spring clutch 47 controlled by the solenoid 46, and a gear train 48 connected to the spring clutch 47 are provided. Each action of the solenoid 46, through the spring clutch 47, allows the gear train 48 to make one rotation of the upper rotation axis 28.

The operation of the ADF will now be described in the following.

When a plurality of sheets of original are to be successively copied by employing the ADF 6, the sheets of original are first stacked on the tray 10, such that the leading edge of the sheets is in contact with the stopper 10*b* of the tray 10. At the present stage, the hold-back member 42 is located in the position shown in FIG. 4, to hold back the sheets of original. The mounting surfaces 32*a* of the supporting arms 32 abut against the driving projections 39*a* of the cams 39 to maintain the supporting arms 32 in their upper position as shown in FIG. 4. Therefore, the feeding rollers 34 are located above the stacked sheets of original.

At the instant of placing the sheets of original in the tray 10, the set-sheet-detecting switch 40 is activated, whereby a signal which contains the information of sheet existence is outputted to the control unit of the ADF 6.

Under the circumstances, as the print button of the copying machine body 5 is pressed, a signal to start feeding the sheets is outputted from the control unit of the copying machine body 5 to the control unit of the ADF 6. Accordingly, the motor 17 starts rotating. When a predetermined period of time has elapsed since the start of the motor 17, the solenoid 45 is actuated in order to turn the hold-back member 42 clockwise against the tension spring 44. Thereby, as shown in FIG. 7A, a sheet of original is fed.

Figure 7A:
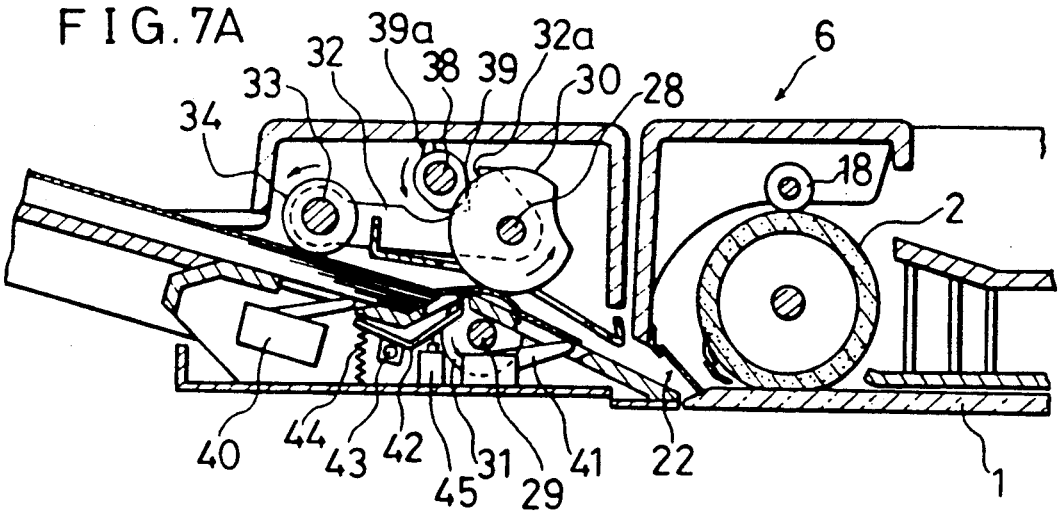
FIGS. 7A to 7E are sectional front views showing parts of the ADF, for explaining the operation of the ADF.

As the motor 17 rotates, the lower rotation axis 29 rotates counterclockwise in FIG. 7A. When a predetermined period of time has elapsed since the start of the motor 17, the solenoid 46 connected to the spring clutch 47 is actuated, only after a predetermined period of time. This causes one rotation of the upper rotating axis 28 in the counterclockwise direction. This rotation is transferred through the timing belts 37 to the rotation axis 33, so that the rotation axis 33 also rotates in the counterclockwise direction. At the same time, one rotation of the cam axis 38 having cams 39 is also made in the same direction. Accordingly, the driving projections 39*a* of the cams 39 leave the mounting surfaces 32*a* of the supporting arms 32, so that the pair of supporting arms 32 rotate counterclockwise in FIG. 7A on the upper rotation axis 28, due to the weight of the arms 32, viz., the rotation axis 33 provided in the tip end of the arms 32, etc. Consequently, the rotation axis 33 and the feeding rollers 34 thereon drop in to the position shown in FIG. 7A, wherein which the rollers 34 are in contact with the top sheet of original.

In the above operation, the feeding rollers 34 rotates counterclockwise, and the feeding rollers 30 and the reverse rollers 31 also rotate counterclockwise. Therefore, the feeding rollers 34 transport the top sheet of original in the tray 10 toward the feeding rollers 30, and then the feeding rollers 30 transport the fed sheet toward the transporting roller 2. The reverse rollers 31 restrain the lower sheets in order not to allow a plurality of sheets to be transported at one time.

Figure 7B:
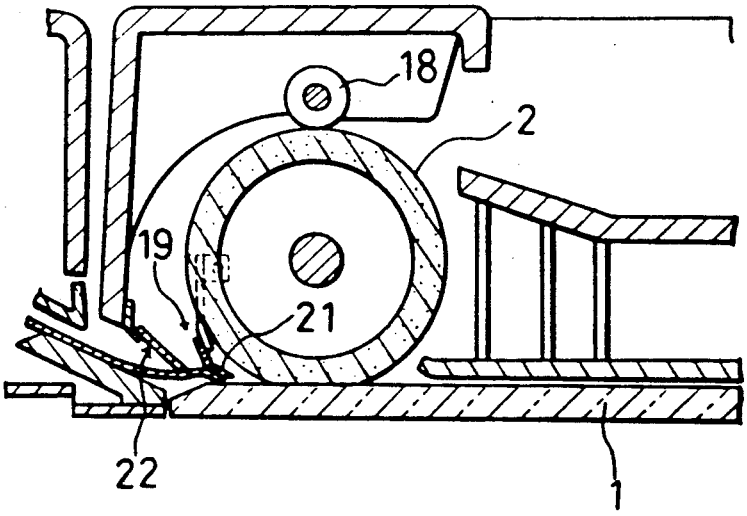

The fed sheet turns on the fed-sheet-detecting switch 41, and it moves under the discharging guide 22 to the transporting roller 2. Referring to FIG. 7B, just before the leading edge of the sheet reaches the transporting roller 2, the edge of the sheet moves to the guide member 21 of the guiding means 19. Since the sheet is forced to move, the leading edge of the sheet moves along the guide member 21 toward the nipping position between the transporting roller 2 and the contact glass 1. During the above operation, the transporting roller 2 stops rotating.

Since the solenoid 46 is actuated only during a period of time, the feeding rollers 30 stop after one rotation is made, whereas the reverse rollers 31 continue to rotate. The cam axis 38 also stops after one rotation is made. As a result, the driving projections 39*a* of the cams 39 push against the mounting surfaces 32*a* of the supporting arms 32, whereby the feeding rollers 34 are raised again into their upper position. Since the length of the circumference of the feeding rollers 30, and the distance between the feeding rollers 30 and the nipping position between the transporting roller 2 and the contact glass 1, are so determined that a sheet continues to be transported during a predetermined period of time after the leading edge of the sheet reaches to the nipping position, a distorted or skewed sheet may be thereby corrected in its position.

At this instant, the rear portion of the sheet is still located between the feeding rollers 30 and the reverse rollers 31. However, the feeding rollers 30 do not affect the sheet, since the feeding rollers 30 stop when the notches 30*a* are positioned toward the bottom.

Figure 7C:
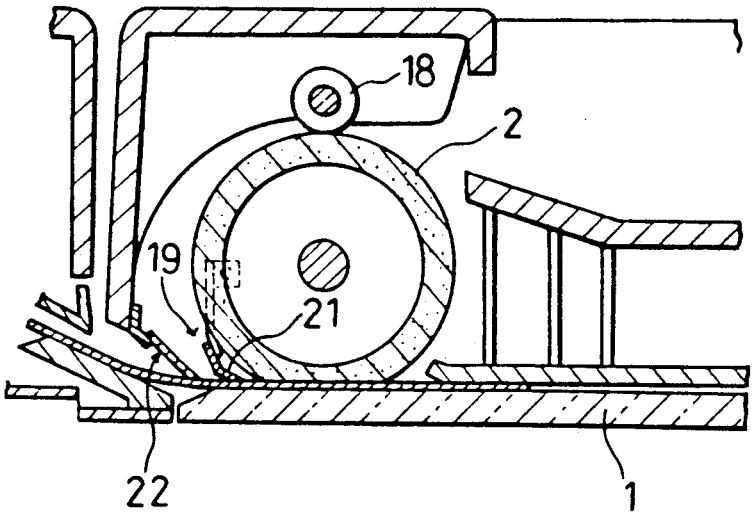

As a predetermined period of time has elapsed since the fed-sheet-detecting switch 41 detected the sheet, the transporting roller 2 starts rotating counterclockwise to transport the sheet onto the contact glass 1. (See FIG. 7C) As described above, transportation of the sheet is not obstructed by the feeding rollers 30 which have stopped due to the notch 30*a*, although the rear portion of the sheet is still located between the feeding rollers 30 and the reverse rollers 31.

Figure 7D:
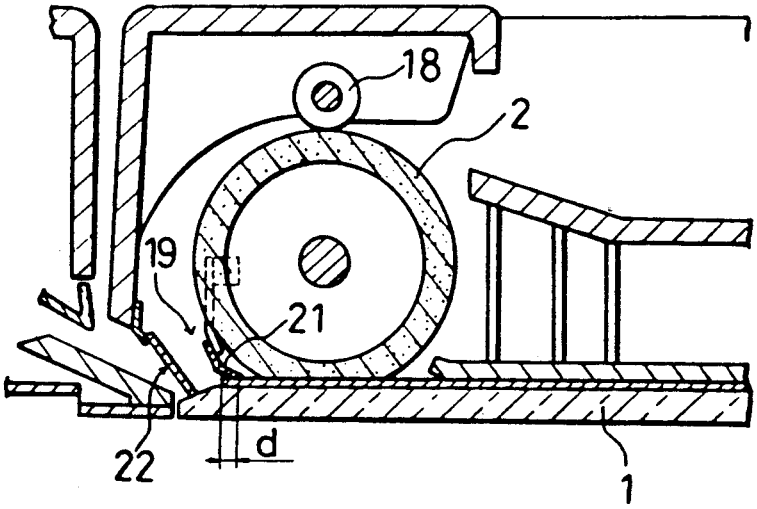

As the sheet is forwarded by the transporting roller 2, the rear end of the sheet passes the fed-sheet-detecting switch, so that the fed-sheet-detecting switch 41 is turned off. When a predetermined period of time has elapsed since this instant, the motor 17 stops, to discontinue transporting the sheet. As shown in FIG. 7D, the rear, or left, portion of the sheet completely supplied to a reading position is still nipped between the transporting roller 2 and the contact glass 1. The rear edge of the sheet is located apart from the bottom end of the guide member 21 by the distance d to the left side of the bottom of the guide member 21 in the figure.

After the completion of the above transportation of the sheet, the copying process of the copying machine body 5 starts, wherein an exposure system of the copying machine body 5 moves to optically scan the sheet in the reading position on the contact glass 1 for reading image information. When the scanning is completed, the control unit of the copying machine body 5 outputs a signal to the ADF 6.

Figure 7E:
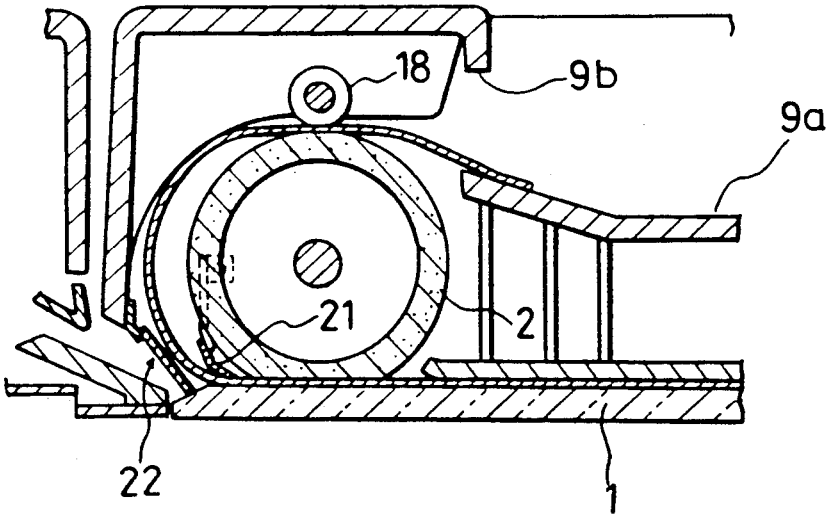

Accordingly, the motor 17 starts rotating in the direction opposite to that in the above, whereby the transporting member 2 starts rotating clockwise. During the rotation of the transporting roller 2, the sheet on the contact glass 1 is transported as shown in FIG. 7E. Since the rear end of the sheet on the contact glass 1 is to the left of the guide member 21, as described above, even before the transporting roller 2 starts rotating clockwise, the guide member 21 cannot obstruct the sheet. The moving sheet repelled by the transporting roller 2 is scooped by the discharging guide 22, and discharged through the opening 9*b* into the depression 9*a* by the transporting roller 2 and the counter roller 18 which presses on the transporting roller 2. Due to the fact that the length of the sheet is measured as the sheet is being supplied, the motor 17 will stop rotating when the completion of the discharging of the sheet is deemed to be carried out, according to the measurement.

Subsequent to one sheet of original being discharged as described above, it is decided whether or not any additional sheets of original exist in the tray 10. That is, the set-sheet-motor 17 automatically starts rotating, to supply the next sheet and perform the further operations as described above.

In this embodiment, a sheet having a curled end may be smoothly transported, without any transportation deficiencies, since the curled end is guided by the guide member 21 down toward the nipping position.

The contact glass 1 of the embodiment has the slope 1*a* along the edge adjacent to the tray 10, since the bottom end of the discharging guide 22 must be located below the upper surface of the contact glass 1, in this type of apparatus, whereby a sheet is scooped when discharged. The leading edge of a sheet of original must be moved toward the slope 1*a*, wherein the leading edge of the sheet may turn upward, or become curled. That is, the slope 1*a* can be an obstacle to guiding the leading edge of a sheet of original to the nipping position between the transporting roller 2 and the contact glass 1. However, according to the embodiment, since the guide member 21 is provided, such a curled portion may be smoothed and guided down toward the nipping position.

(MODIFICATIONS)

(a) In the above embodiment, the present invention is applied to the type of ADF shown in FIG. 4. However, the present invention also may be applied to any other types of ADF in which a sheet is transported by a transporting roller which presses on a plane member, in order to solve the problems of transportation member, in order to solve the problems of transportation deficiency.

Figure 8:
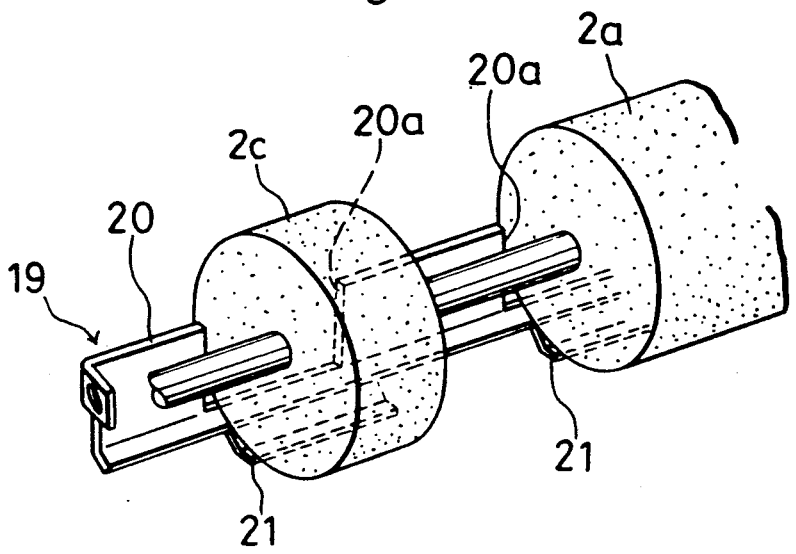
FIG. 8 is an isometric view, in correspondence with FIG. 6, showing another embodiment of the present invention.

(b) Although the guide member 21 extends uniformly in the depth direction in the above embodiment, a guide member 21 may be provided exclusively in correspondence with the transporting roller 2, as shown in FIG. 8.

(c) The present invention can be applied not only to copying machines but also to other types of apparatuses for transporting sheets of original, in which information from original is read while a sheet is moving, such as in facsimile machines.

Figure 9:
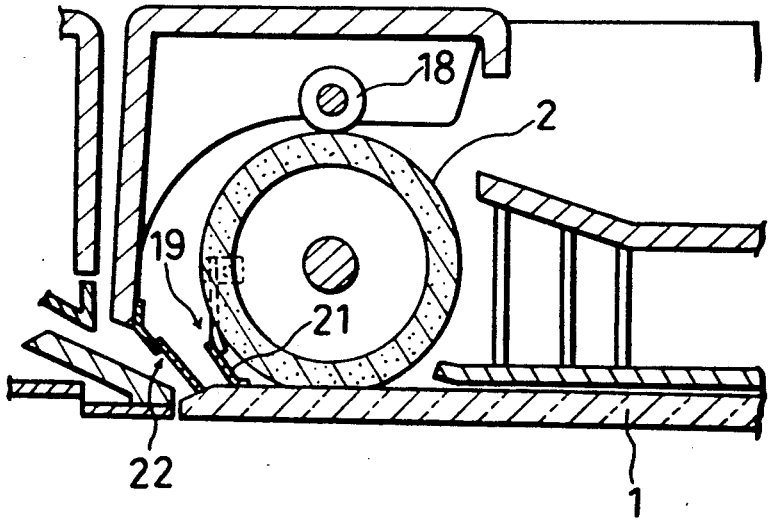
FIG. 9 is a sectional front view showing yet another embodiment of the present invention.

(d) The guide member 21 is made of a stainless steel plate in the above embodiment. However, the guide member 21 may be made of a resin film, such as polyester film or polyethylene terephthalate film. A guide member 21 made of resin film may be, as shown in FIG. 9, in contact with the contact glass 1 along its bottom edge, so that gap control is not necessary.

Various details of the invention maybe changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An apparatus for automatically transporting a sheet of original from an upstream position to a downstream reading position on a transparent plane member of an image forming apparatus, comprising:

sheet setting means for accommodating a sheet of original;

a transporting rolling device positioned downstream from said sheet setting means, and said transporting rolling device being dimensioned and arranged so as to press against the transparent plane member;

feeding means for feeding the sheet of original from said sheet setting means towards said transporting roller device such that a leading edge of the sheet of original is placed into a nipping position between said transporting rolling device and the transparent plane member;

rotating means for rotating said transporting rolling device, said rotating means including means for maintaining said transporting rolling device stationary during the positioning of the leading edge of the sheet in the nipping position, said rotating means further including timing means for initiating rotation of said transporting rolling device after a predetermined period has elapsed following the positioning of the leading edge of the sheet in said nipping position; and guiding means for guiding the leading edge of the sheet of original, said guiding means being positioned upstream of the leading edge of the sheet when the sheet is in the reading position.

2. An apparatus according to claim 1 wherein said sheet feeding means includes means for discontinuing feeding of the sheet after a predetermined period of time has elapsed following the positioning of the leading edge of the sheet in said nipping position.

3. An apparatus according to claim 2 wherein said guiding means is positioned such that an edge of said guiding means positioned closest to said plane member is in a position between the leading edge and the rear edge of the sheet while the sheet is in said reading position on said plane member.

4. An apparatus according to claim 3 wherein said means for rotating said transporting rolling device includes reverse rotation means which is activated when discharging the sheet from said reading position, and said reverse rotation means being dimensioned and arranged so as to drive said transporting rolling device in a direction opposite to the direction of rotation said transporting rolling device assumes when transporting the sheet to said reading position.

5. An apparatus according to claim 4 further comprising:

a housing containing said transporting rolling device and said guiding means, and said housing having a sheet-receiving portion formed in an upper portion of said housing for receiving the discharged sheet, and an opening formed between said transporting rolling device and said sheet receiving portion for guiding the sheet to said sheet receiving portion; and a discharging guide disposed between said transporting rolling device and said sheet feeding means, said discharging guide being dimensioned and arranged for one way passage of the leading edge of the sheet from said sheet feeding means to said plane member and past an edge of said discharging guide, and said discharging guide also being dimensioned and arranged for guiding said sheet from said plane member to said opening in said housing.

6. An apparatus according to claim 5 wherein said plane member has a slope descending in a downstream to upstream direction towards said sheet feeding means; and said discharging guide having a bottom edge in contact with said slope.

7. An apparatus according to claim 5 wherein said housing is pivotable on its rear axis.

8. An apparatus according to claim 3 further comprising a housing containing said transporting rolling device and said guiding means; wherein said guiding means includes a supporting member fixed to said housing and a guiding member fixed to said supporting member.

9. An apparatus according to claim 8 wherein said guiding means extends uniformly along the longitudinal direction of said transporting rolling device.

10. An apparatus according to claim 8, wherein said transporting rolling device includes a rotation axis rotatably supported by said housing and a roller fitted on said rotation axis; and said roller has a central roller portion disposed on the middle portion of said rotation axis, and side roller portions to each side of said central roller portion on said rotation axis and said rotating means including means for rotating said rotation axis.

11. An apparatus according to claim 10 wherein said guiding member is located in between said central roller portion and said side roller portions of said transporting rolling device.

12. An apparatus according to claim 8 wherein said guiding member has a bottom end spaced above said plane member.

13. An apparatus according to claim 12 wherein said guiding member is made of a stainless steel plate.

14. An apparatus according to claim 8 wherein said guiding member is made of a resin film.

15. An apparatus according to claim 14 wherein said guiding member has a bottom end in contact with said plane member.

16. An apparatus according to claim 2 wherein said sheet feeding means has a feeding roller mechanism for feeding a sheet of original from said sheet setting means to said transporting rolling device, and a separating roller mechanism to prevent the feeding of a plurality of sheets at one time.

17. An apparatus according to claim 2 further comprising a housing containing said transporting rolling device and said guiding means; wherein said transporting rolling device has a rotation axis rotatably supported by said housing and a roller fixed on said rotation axis; and said roller having its outer surface made of soft material.

18. An apparatus according to claim 1 wherein said plane member is a contact glass of said image forming apparatus.

19. An apparatus as recited in claim 2 further comprising a sheet-feed-detection device and wherein said means for rotating said transporting rolling device is in communication with said sheet-feed-detection device and said means for rotating said transporting rolling device includes means for stopping rotation of said transporting rolling device after a predetermined period of rotation has surpassed which places the sheet of original in said reading position with the trailing edge of the sheet upstream of said nipping position.

20. An apparatus according to claim 19 wherein said guiding means is positioned such that an edge of said guiding means positioned closest to said plane member is in a position between the leading edge and the trailing edge of the sheet while the sheet is in said reading position on said plane member.

21. An apparatus as recited in claim 1 wherein an edge of said guiding means closest to said plane member is positioned between the upstream end of said plane member and said nipping position.

22. An apparatus as recited in claim 21 further comprising a discharging guide positioned downstream of the upstream edge of said plane member and upstream of said guiding means.

23. An apparatus for automatically transporting a sheet of original from an upstream position to a downstream reading position on a transparent plane member of an image forming apparatus, comprising:

sheet setting means for accommodating a sheet of original;

a transporting rolling device positioned downstream from said sheet setting means and dimensioned and arranged so as to press against the transparent plane member;

feeding means for feeding the sheet of original from said sheet setting means towards said transporting rolling device such that a leading edge of the sheet of original is placed into a nipping position between said transporting rolling device and the transparent plane member;

means for rotating said transporting rolling device, said means for rotating said transporting rolling device including means for rotating said transporting rolling device in a first direction wherein the sheet of original positioned in the nipping position is moved to the reading position, and said means for rotating said transporting rolling device including means for rotating said transporting rolling device in an opposite discharging direction; and guiding means for guiding the leading edge of the sheet of original into the nipping position, said guiding means being dimensioned and arranged such that an edge of said guiding means adjacent the plane member is positioned between the leading edge and the trailing edge of the sheet of original when the sheet of original is in the reading position.

24. An apparatus according to claim 23 further comprising:

a housing containing said transporting rolling device and said guiding means, said housing including, at an upper end thereof, a sheet-receiving portion for receiving a discharged sheet, and said housing including an opening through which the discharge sheet passes when being discharged to said sheet-receiving portion; and a discharging guide disposed between said transporting rolling device and said sheet-feeding means, said discharging guide being dimensioned and arranged for allowing one way passage of the sheet from said sheet feeding means to the reading position on the plane member, and for guiding the sheet from the plane member to said opening during discharge.

25. An apparatus according to claim 24 wherein the plane member has a sloping upstream end which slopes upwardly in an upstream to downstream direction, and said discharging guide having an end in contact with the sloping upstream end of said plane member.

26. An apparatus for automatically transporting a sheet of original from an upstream position to a downstream reading position on a transparent plane member of an image forming apparatus, comprising:

sheet setting means for accommodating the sheet of original;

a transporting rolling device positioned downstream from said sheet setting means and dimensioned and arranged so as to press against said transparent plane member;

feeding means for feeding the sheet of original from said sheet setting means and into a nipping position between said transporting rolling device and the transparent plane member;

a first guiding device for guiding a leading edge of the sheet into the nipping position between said transporting rolling device and said plane member during feeding of the sheet to the reading position, said guiding device having a lower edge positioned upstream from the nipping position and downstream from an upstream end of said transparent plane member; and a second guiding device for providing guidance during a discharging of the sheet, said second guiding device having a bottom end in contact with said plane member and the bottom end being positioned upstream of the lower edge of said first guiding device and downstream of the upstream end of said plane member.

27. An apparatus as recited in claim 26 wherein the upstream end of said plane member includes a sloping section which slopes upwardly in an upstream to downstream direction, and the bottom end of said second guiding device is in contact with the sloping section.

* * * * *